US006541090B2

(12) United States Patent
Grosskopf et al.

(10) Patent No.: US 6,541,090 B2
(45) Date of Patent: Apr. 1, 2003

(54) RESEALABLE LABEL HAVING LAMINATE COVER

(75) Inventors: Glenn A. Grosskopf, Lake Zurich, IL (US); Carl W. Treleaven, Greensboro, NC (US)

(73) Assignee: Pharmagraphics (Southeast), L.L.C., Greensboro, NC (US)

( * ) Notice: Subject to any disclaimer, the term of this patent is extended or adjusted under 35 U.S.C. 154(b) by 0 days.

(21) Appl. No.: 09/798,159

(22) Filed: Mar. 2, 2001

(65) Prior Publication Data

US 2002/0122910 A1 Sep. 5, 2002

Related U.S. Application Data

(60) Provisional application No. 60/205,358, filed on May 18, 2000.

(51) Int. Cl.[7] ..... G09F 3/02

(52) U.S. Cl. ..... 428/40.1; 428/41.7; 428/41.8; 428/42.2; 428/42.1; 428/194; 281/2; 281/5; 283/81

(58) Field of Search ..... 428/40.1, 194, 428/41.7, 41.8, 42.1, 42.2; 283/81; 281/5, 2

(56) References Cited

U.S. PATENT DOCUMENTS

| | | | | | |
|---|---|---|---|---|---|
| 4,592,572 | A | * | 6/1986 | Instance | 281/2 |
| 4,671,003 | A | | 6/1987 | Vitol | 40/2 R |
| 5,074,595 | A | | 12/1991 | Hill et al. | 283/81 |
| 5,200,243 | A | | 4/1993 | Van Veen | 428/40 |
| 5,234,735 | A | | 8/1993 | Baker et al. | 428/40 |
| 5,389,415 | A | | 2/1995 | Kaufmann | 428/40 |
| 5,399,403 | A | | 3/1995 | Instance | 428/40 |
| 5,439,721 | A | | 8/1995 | Pedroli et al. | 428/40 |
| 5,449,538 | A | | 9/1995 | Denny | 428/40 |
| 5,588,239 | A | | 12/1996 | Anderson | 40/630 |
| 5,727,819 | A | * | 3/1998 | Grosskopf et al. | 283/81 |
| 5,738,381 | A | | 4/1998 | Treleaven et al. | 283/81 |
| 5,766,716 | A | | 6/1998 | Barry | 428/40.1 |
| 5,863,628 | A | * | 1/1999 | Barry | 428/40.1 |
| 5,944,357 | A | | 8/1999 | Instance | 283/101 |
| 5,975,575 | A | | 11/1999 | Instance | 281/2 |
| 5,975,582 | A | | 11/1999 | Treleaven | 283/81 |
| 6,027,780 | A | | 2/2000 | Treleaven et al. | 428/40.1 |
| 6,057,019 | A | | 5/2000 | Barry | 428/40.1 |

FOREIGN PATENT DOCUMENTS

| | | | | |
|---|---|---|---|---|
| WO | WO 00/26886 | * | 5/2000 | G09F/3/02 |

OTHER PUBLICATIONS

Search Report for PCT/US01/07203, dated Oct. 9, 2001.

* cited by examiner

*Primary Examiner*—Harold Pyon
*Assistant Examiner*—Brian P. Egan
(74) *Attorney, Agent, or Firm*—Myers Bigle Sibley & Sajovec

(57) ABSTRACT

A resealable label includes a leaflet having an upper surface and a base tab disposed adjacent the leaflet. The base tab includes a closure portion and a pull tab portion each having an upper surface and a lower surface. The closure portion and the pull tab portion are separated from one another by a cut line therebetween. A varnish coats the upper surface of the closure portion. The label further includes a laminate cover including a first laminate portion overlying the closure portion, a second laminate portion overlying the pull tab portion, and a third laminate portion overlying the leaflet. The label further includes a laminate adhesive including a first adhesive portion releasably and resealably securing the first laminate portion to the varnish on the upper surface of the closure portion, and a second adhesive portion securing the second laminate portion to the upper surface of the pull tab portion. A closure portion adhesive coats the lower surface of the closure portion. The lower surface of the pull tab is substantially free of adhesive.

23 Claims, 6 Drawing Sheets

RESEALABLE LABEL HAVING LAMINATE COVER

RELATED APPLICATIONS

This application claims the benefit of priority of U.S. Provisional Application Serial No. 60/205,358, filed May 18, 2000, the disclosure of which is incorporated herein by reference in its entirety.

FIELD OF THE INVENTION

The present invention relates to labels and, more particularly, to resealable extended text labels.

BACKGROUND OF THE INVENTION

In the packaging of certain chemicals and pharmaceuticals, the manufacturer is often required or desires to provide a considerable amount of information concerning the chemical or pharmaceutical. In the case of pharmaceuticals, this is required by government regulations, however, the occasion may also arise, either separate from or in conjunction with government regulations, to provide the doctor, pharmacist or user with instructions on how the product should be used, what the product is, and safety precautions which should be followed in the use of the product. Similarly, it is often desirable to provide information in multiple languages so that a given product or packaging may be distributed in multiple locations or regions.

Sometimes the literature, which is generally in the form of folded leaflets, is placed within a box along with the container carrying the chemical or pharmaceutical (referred to as "inserts"). The placement of leaflets within the box is expensive and a cumbersome operation to perform. Also, it is difficult to insure by later inspection that the proper literature has been inserted in the proper package. Most all products are packaged in outer cartons and many are not compatible with inserts. Further, the use of folded cartons is under scrutiny by environmental groups, as involving excessive packaging. In an effort to meet this challenge, many companies seek alternatives to folding cartons that carry containers inside.

A different approach to solving this problem has developed over the last several years in which the folded literature is releasably attached to the face of the container (referred to as "outserts"), either directly to the container itself, or to a base label which, in turn, is secured to the container. The literature may then be removed by the customer. In such cases, the portion of the label remaining must carry both an "identification" of the product, for example, information such as trademark, manufacturer, etc., as well as certain "statutory information" (for example, lot number and expiration date).

It is often desirable to provide an extended text label with resealability. Resealability may allow the user to open the label, inspect or remove the interior pages thereof, and thereafter reclose and reseal the label. The interior pages, if not removed, may then be referred to again later. Additionally, the various panels of the label are retained in a closed configuration so that they do not dangle and interfere with the handling of and detract from the appearance of the associated article.

SUMMARY OF THE INVENTION

According to embodiments of the present invention, a resealable label includes a leaflet having an upper surface and a base tab disposed adjacent the leaflet. The base tab includes a closure portion and a pull tab portion each having an upper surface and a lower surface. The closure portion and the pull tab portion are separated from one another by a cut line therebetween. A varnish coats the upper surface of the closure portion. The label further includes a laminate cover including a first laminate portion overlying the closure portion, a second laminate portion overlying the pull tab portion, and a third laminate portion overlying the leaflet. The label further includes a laminate adhesive including a first adhesive portion releasably and resealably securing the first laminate portion to the varnish on the upper surface of the closure portion, and a second adhesive portion securing the second laminate portion to the upper surface of the pull tab portion. A closure portion adhesive coats the lower surface of the closure portion. The lower surface of the pull tab is substantially free of adhesive.

The label may include a leaflet base adhesive coating a lower surface of the leaflet, wherein the leaflet base adhesive and the closure portion adhesive define an adhesive-free gap therebetween. The base tab may be disposed substantially immediately adjacent the leaflet and be separated therefrom by a second cut line, the second cut line overlying the adhesive-free gap.

The leaflet may include a bottom panel and a top panel overlying and joined to the bottom panel along a fold, the upper surface of the leaflet being an upper surface of the top panel. The base tab is disposed adjacent the fold.

The label may include a second base tab disposed adjacent an end of the leaflet opposite the base tab and a tab adhesive coating a lower surface of the second base tab. The laminate cover includes a marginal laminate portion overlying the second base tab. The laminate adhesive includes a marginal adhesive portion securing the marginal laminate portion to an upper surface of the second base tab. A second varnish may coat the upper surface of the second base tab, whereby the marginal adhesive portion releasably and resealably secures the marginal laminate portion to the second varnish on the upper surface of the second base tab.

According to method embodiments of the present invention, a method for forming a resealable label includes providing a leaflet and forming a first cut line in the leaflet to form a leaflet portion and a base tab portion. A second cut line is formed in the base tab portion to form a closure portion and a pull tab portion. A lower surface of the closure portion is coated with a closure portion adhesive such that a lower surface of the pull tab portion remains substantially free of adhesive. An upper surface of the closure portion is coated with a varnish. A laminate web is applied over the leaflet portion, the closure portion and the pull tab portion such that the laminate web is adhered to at least the varnish coated upper surface of the closure portion and an upper surface of the pull tab portion.

Objects of the present invention will be appreciated by those of ordinary skill in the art from a reading of the figures and the detailed description of the preferred embodiments which follow, such description being merely illustrative of the present invention.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. The thicknesses of various layers may be exaggerated for clarity.

Figure 1:
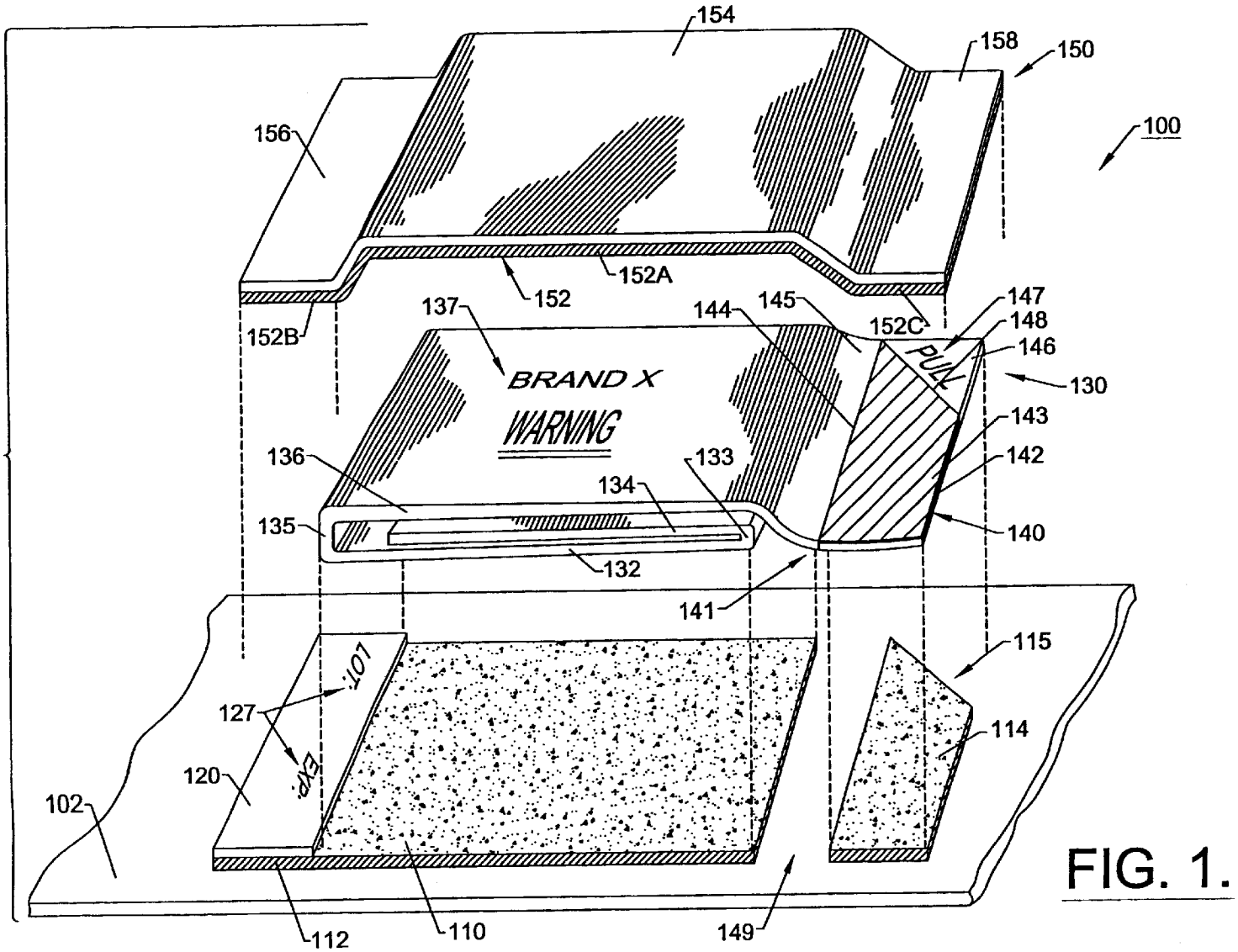
FIG. 1 is an exploded, perspective view of a label according to the present invention disposed on a release liner.
Figure 2:
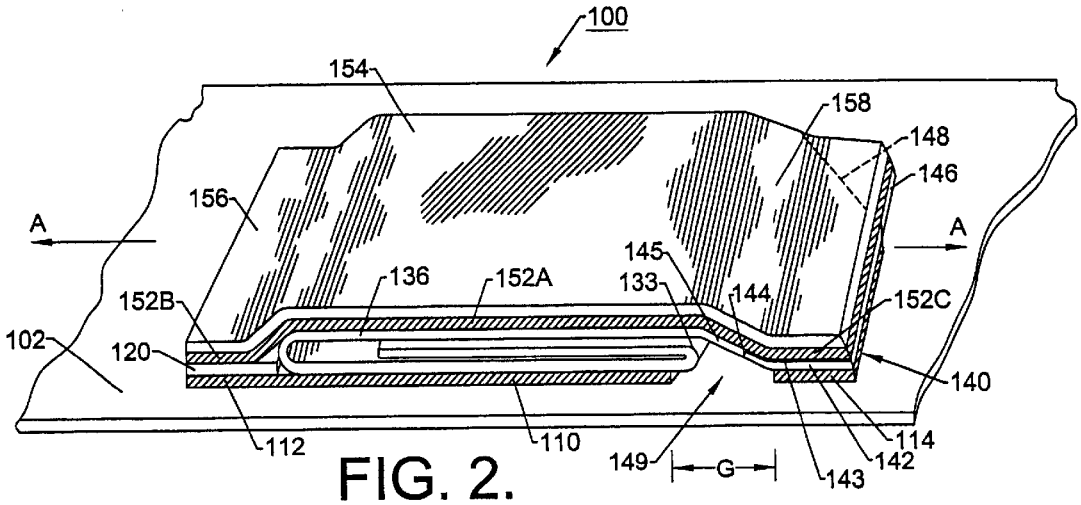
FIG. 2 is a perspective view of the label of FIG. 1 disposed on a release liner and in a stored position.
Figure 3:
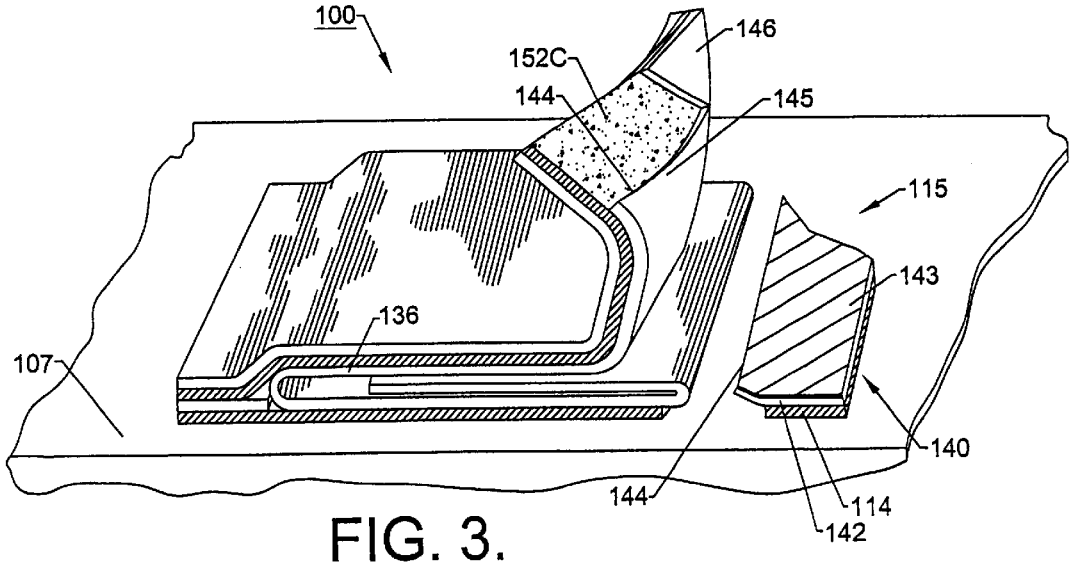
FIG. 3 is a perspective view of the label of FIG. 1 mounted on an article and in an open position.

With reference to FIGS. 1–3, a label 100 according to embodiments of the present invention is shown therein disposed on a release liner 102. The label includes adhesive patches 110, 112 and 114, a leaflet 130, a base tab 140, a base. tab 120, and a self-adhesive laminate cover 150. The label 100 may be mounted on an article, for example, the article 107 (see FIG. 3) by means of the adhesive patches 110, 112, 114. The label 100 may thereafter be transitioned from a stored position as shown in FIG. 2 to an open position as shown in FIG. 3 (wherein the label 100 is shown partially open), as discussed in detail below. For the purposes of explanation, the label 100 has a lengthwise axis A—A (see FIG. 2).

The adhesive patches 110, 112, 114 are preferably formed of a pressure-sensitive adhesive. Suitable pressure-sensitive adhesives include product number HL2203X available from H.B. Fuller Adhesives of Minneapolis, Minn. Preferably, the adhesive patches 110 and 112 form a single, continuous adhesive patch. The adhesive patch 114 is spaced from the adhesive patch 110 to define an adhesive-free gap 149 therebetween. Preferably, the gap 149 has a width G of between about 1/16 and 3/8 inch (see FIG. 2). The adhesive patch 114 is truncated such that an adhesive void 115 is defined along an outer corner thereof.

Preferably, the tab 120 is formed of the same material as the leaflet 130, as discussed below. More preferably, the tab 120 and the leaflet 130 are formed from adjacent leaflet blanks 130A (see FIG. 4) as described below. Indicia 127 such as lot and expiration prompts may be printed on the upper surface of the tab 120.

As best seen in FIG. 1, the leaflet 130 includes a bottom panel 132 and an interior panel 134 joined to the bottom panel 132 along a fold 133. A top panel 136 is joined to the bottom panel 132 along a fold 135. An integral extended flap 141 extends from the top panel 136 beyond the fold 133.

A transverse cut line 144 extends through the extended flap 141. Preferably, the cut line 144 extends substantially perpendicular to the axis A—A and across the entire width of the extended flap 141. The cut line 144 divides the extended flap 141 into a connected portion 145 which is connected to the top panel 136, and the base tab 140 which is severed from the top panel 136 by the cut line 144. A further, angular cut line 148 in the extended flap 141 (and, more particularly, in the base tab 140) separates a triangular pull tab portion 146 from a closure portion 142. Preferably, the cut line 148 forms an angle of about 45 degrees with the cut line 144. Alternatively, the cut line 148 may be disposed perpendicular to the cut line 144 so that the pull tab portion 146 is rectangular. Indicia 147 such as "PULL" or "LIFT" is printed on the pull tab 146. Identification, informational or other indicia 137 may be printed on the upper and lower surfaces of the panels 132, 134, 136. Indicia (not shown) such as lot and expiration prompts may be printed on the upper surface of the closure portion 142.

The closure portion 142 is coated on its rear surface by the adhesive patch 114 and is thereby releasably secured to the release liner 102. The pull tab 146 overlies the adhesive void 115 so that the rear surface of the pull tab 146 is substantially free of adhesive. The connected portion 145, the cut line 144 and an inner portion of the closure portion 142 overlie the adhesive-free gap 149 and are therefore also substantially free of adhesive on their lower surfaces.

A varnish coating 143 is disposed on the upper surface of the closure portion 142. Preferably, the varnish 143 coats the entirety of the upper surface of the closure portion 142. The varnish 143 does not substantially coat the upper surface of the pull tab 146. Suitable varnishes include product number L075 available from Paragon Inks of Boxburn, Scotland.

The laminate cover 150 is coated on its rear surface by a pressure-sensitive adhesive 152. A central portion 154 of the laminate cover 150 is adhered to the top panel 136 by an adhesive portion 152A. A marginal portion 156 of the laminate cover 150 is adhered to the upper surface of the tab 120 by an adhesive portion 152B. An opposed marginal portion 158 of the laminate cover 150 is adhered to the upper surfaces of the closure portion 142 and the pull tab 146 by an adhesive portion 152C. Notably, the portion of the adhesive portion 152C overlying the closure portion 142 engages the varnish 143 and the portion of the adhesive portion 152C overlying the pull tab 146 directly engages and permanently adheres to the pull tab 146.

The laminate cover 150 is preferably formed of a 1.5 mil polypropylene film. Suitable laminate adhesives 152 include emulsion acrylic adhesives. Suitable laminate/laminate adhesive materials include product number 505 from Adhesive Coated Products of Troy, Ohio. The laminate cover 150 may be formed of a transparent material or of an opaque material. If the laminate cover 150 is opaque, then the indicia 147 should be printed on the portion of the marginal portion 158 overlying the pull tab 146.

The label 100 may be used in the following manner. The label 100 may be applied to the article 107 (see FIG. 3), for example, by means of the adhesive patches 110, 112, 114 and using suitable automatic or manual labeling equipment. Initially, the label 100 will be disposed in a stored position as shown in FIG. 2. When the user desires to open the label 100, the user may grasp the pull tab 146 and the overlying laminate portion 158. Notably, the pull tab 146 will be convenient to grasp because it is not coated on its rear surface with adhesive. The user may then lift the pull tab 146 upwardly and leftwardly along the axis A—A. As the pull tab 146 is pulled, the adhesive portion 152C separates from the varnish 143 up to the cut line 144. Thereafter, the top panel 136 and the central portion 154 of the laminate cover may be freely lifted to access the interior of the leaflet 130. The closure portion 142 remains with the article 107 while the pull tab 146 remains with the laminate cover 150. The user may reclose and reseal the label 100 by folding the top panel 136 down and reapplying the adhesive portion 152C to the varnish 143.

Optionally, tear lines may be provided adjacent the fold 135 and between the laminate portions 154 and 156. Alternatively or additionally, a tear line may be formed adjacent the fold 133.

Figure 4:
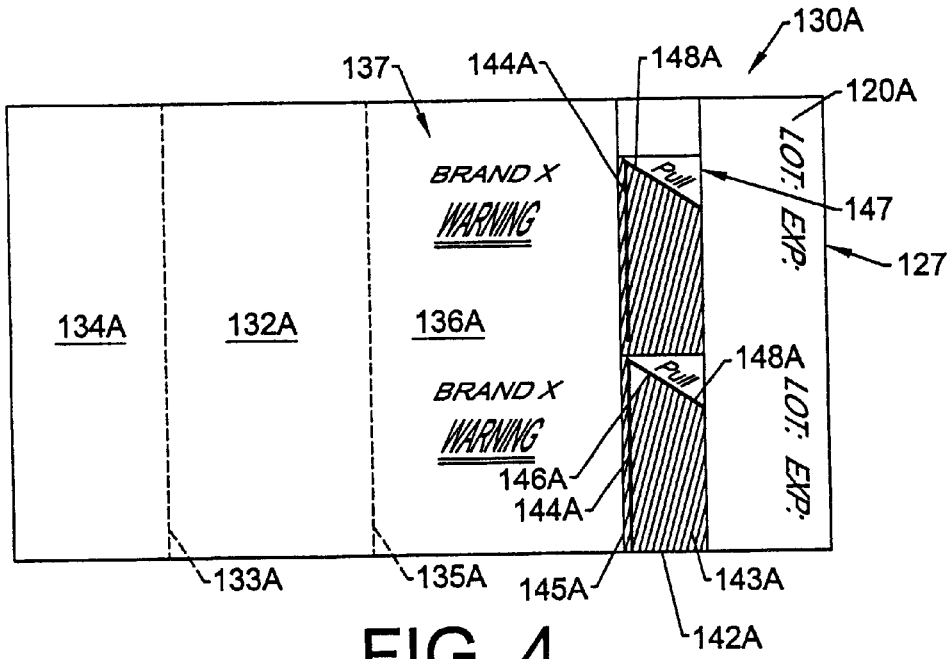
FIG. 4 is a top view of a leaflet blank for forming the label of FIG. 1.

The label may be formed using a method according to the present invention as follows. A multiple-up leaflet blank 130A as shown in FIG. 4 is provided. The leaflet blank 130A is preferably formed of a unitary sheet of paper, film or other suitable material. Preferably, the leaflet blank 130A is cut from a web of such material following the printing and die cutting steps discussed just below.

The leaflet blank 130A includes panels 132A, 134A, and 136A corresponding to the panels 132, 134 and 136. The leaflet blank 130A includes portions 145A, 142A, 146A and 120A corresponding to the portions 145, 142, 146 and 120. Prior to cutting the leaflet blank 130A, the indicia 127, 137, 147 are printed thereon. Additionally, cut lines 144A and 148A corresponding to the cut lines 144 and 148 are formed in the leaflet blank before the blank is cut from the web. A strip of varnish 143A corresponding to the varnish 143 extends across the leaflet blank 130A. The leaflet blank 130A is folded about fold lines 133A and 135A (corresponding to the fold lines 133 and 135) to form a multiple-up leaflet 130B (see FIG. 7) configured generally in the same manner as the leaflet 130 (see FIG. 1).

Figure 5:
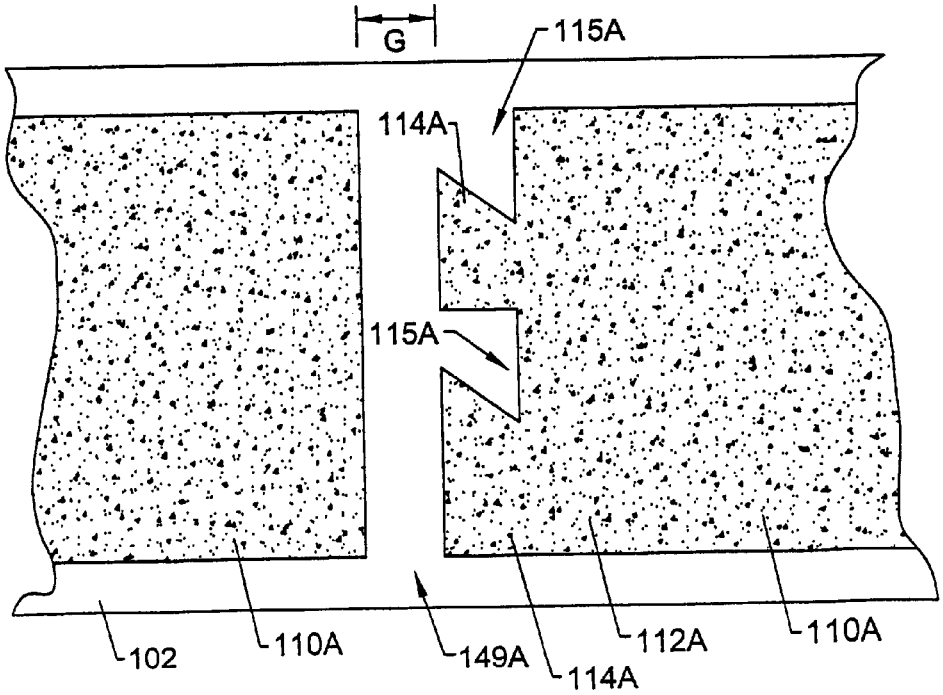
FIG. 5 is a top view of the release liner with adhesive patches disposed thereon in accordance with a method according to the present invention for forming the label of FIG. 1.
Figure 7:
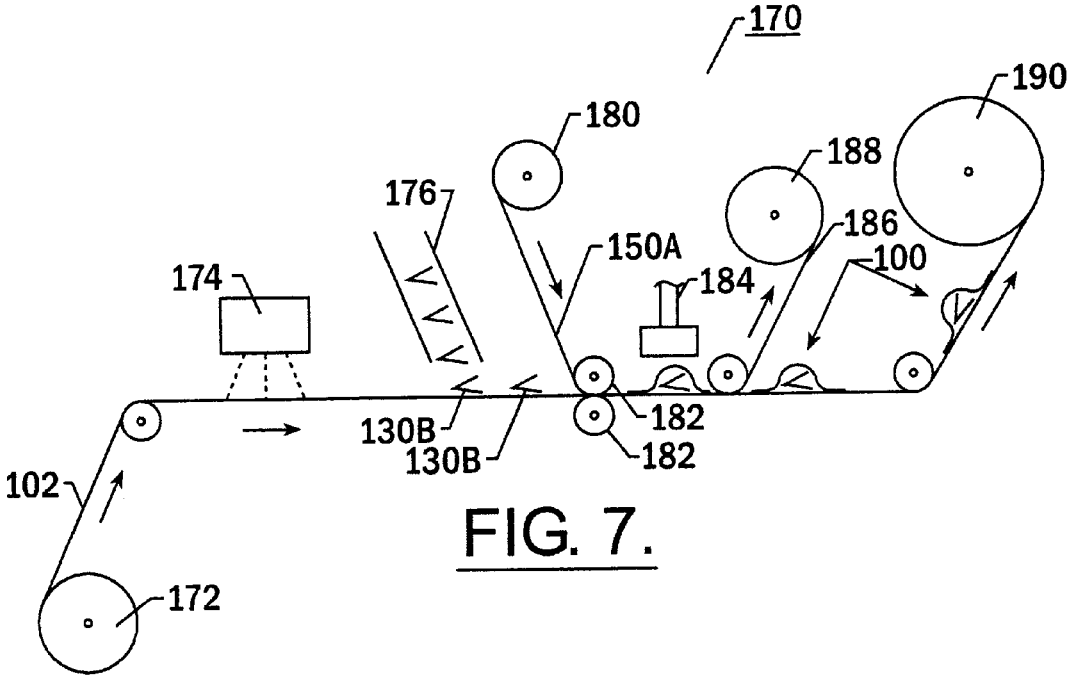
FIG. 7 is a schematic diagram of an apparatus for forming the label of FIG. 1.

With reference to FIG. 7, an apparatus 170 for forming the label 100 is shown therein. The release liner 102 is supplied from an unwind stand 172. An adhesive applicator 174 prints adhesive patches 110A, 112A, 114A as shown in FIG. 5. Preferably, the adhesive applicator 174 is a flexographic adhesive printer. The adhesive applicator 174 also leaves a pattern of voids 115A and 149A corresponding to the adhesive voids 115 and 149. Suitable adhesive applicators include a FlexoCoat PrintCoat Pattern Applicator, model number HM410, available from FlexoCoat International, Inc.

The multiple-up leaflets 130B are applied to the adhesive coated release liner by a leaflet applicator 176. Suitable leaflet applicators include an Onserter 750 available from Onserts, Inc.—Longford Equipment of Toronto, Canada. More particularly, the leaflet 130B is applied such that the portion 120A overlies the adhesive portion 112A, the panel 132A overlies the adhesive portion 110A, the cut line 144A and the portion 145A overlie the adhesive void 149A, the portions 146A overlie the adhesive voids 115A, and the portions 142A overlie the adhesive portions 114A. Preferably, and as shown in FIG. 6, the leaflets are applied end-to-end and, more preferably, substantially immediately adjacent.

A self-adhesive laminate web 150A (corresponding to the laminate cover 150) is supplied from an unwind stand 180 and married to the release liner 102 and the multiple-up leaflet 130B by nip rollers 182. The laminate web 150A may be a self-wound self-adhesive web or may be a non-self-adhesive web to which the adhesive is applied on the apparatus 170.

Figure 6:
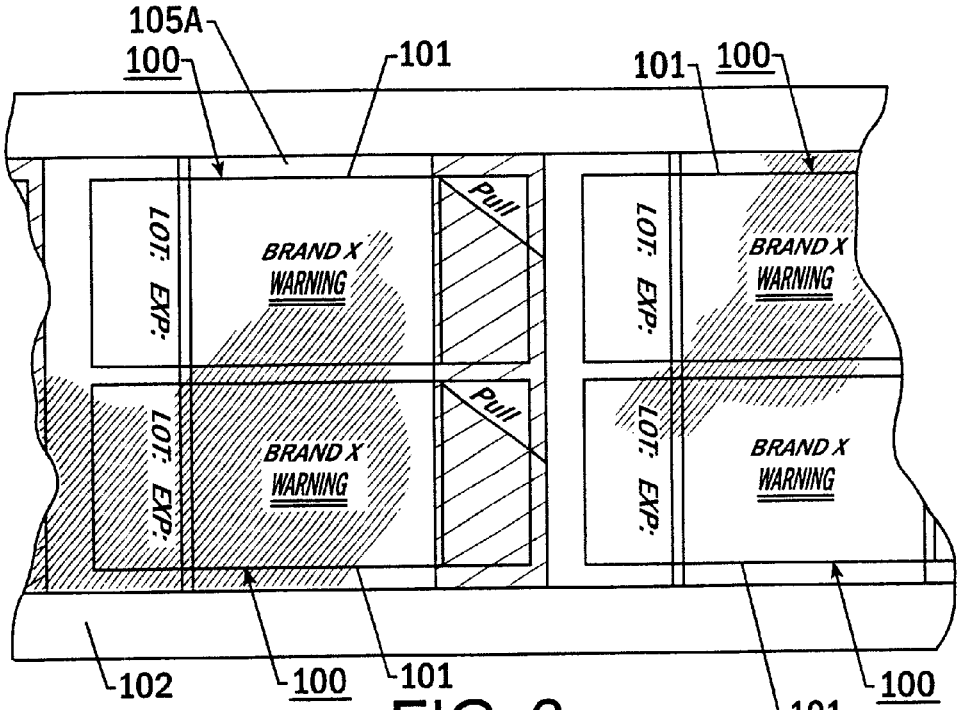
FIG. 6 is a top view of an intermediate construction according to the method of the present invention for forming the label of FIG. 1.

A die cutter 184 forms cut lines 101 through the laminate web 150A, the multiple-up leaflets 130B, and the adhesive patches 110A, 112A, 114A to form the intermediate construction as shown in FIG. 6. The die cut lines 101 sever a portion of each portion 120A from the remainder of the corresponding leaflet blank 130A such that the portion 120A becomes a part of the adjacent label 100 rather than the label 100 that includes the leaflet formed from the same leaflet blank 130A. The die cut lines 101 define the respective side by side and seriated labels 100 and preferably substantially intersect the cut lines 144A and 148A as shown in FIG. 6. A waste matrix 186 consisting of those portions of the laminate web 150A, the leaflets 130B, and the adhesive portions 110A, 112A, 114A outside of the labels 100 is taken up on a wind stand 188. The labels 100 which remain on the release liner 102 may thereafter be wound onto a roll 190.

Optionally, the cut lines 144, 148 may be formed in the leaflet 130 or the leaflet 130B after the leaflet is placed on the web 102 by undercutting through the web 102 and up to the web 150A, rather than forming the cuts in the blank 130A prior to folding.

As a further alternative, the release liner 102 may be replaced with a web including a release liner and an overlying self-adhesive face stock web. In this case, the finished labels will include a coextensive self-adhesive base label.

Figure 8:
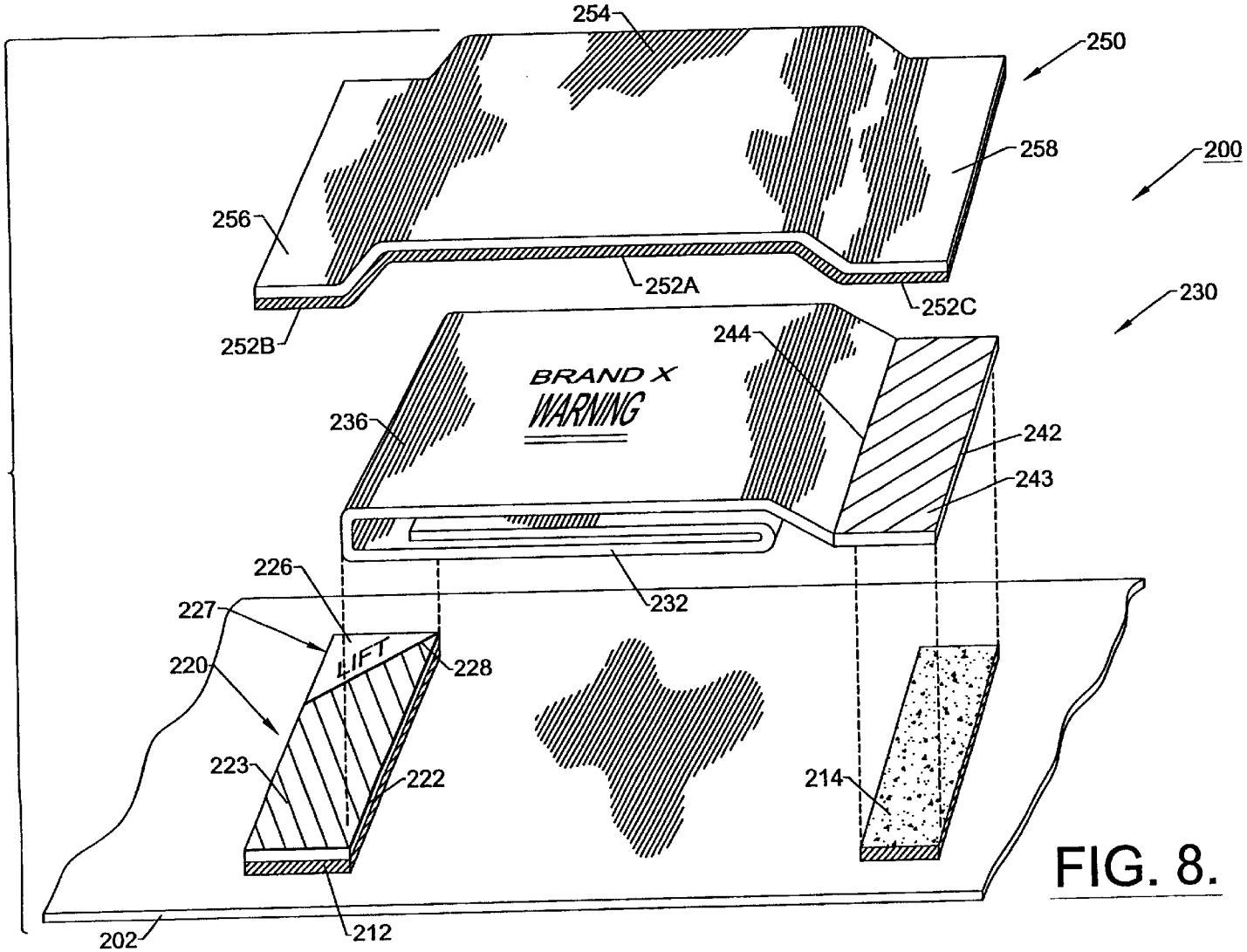
FIG. 8 is an exploded, perspective view of a label according to a further embodiment of the present invention disposed on a release liner.
Figure 9:
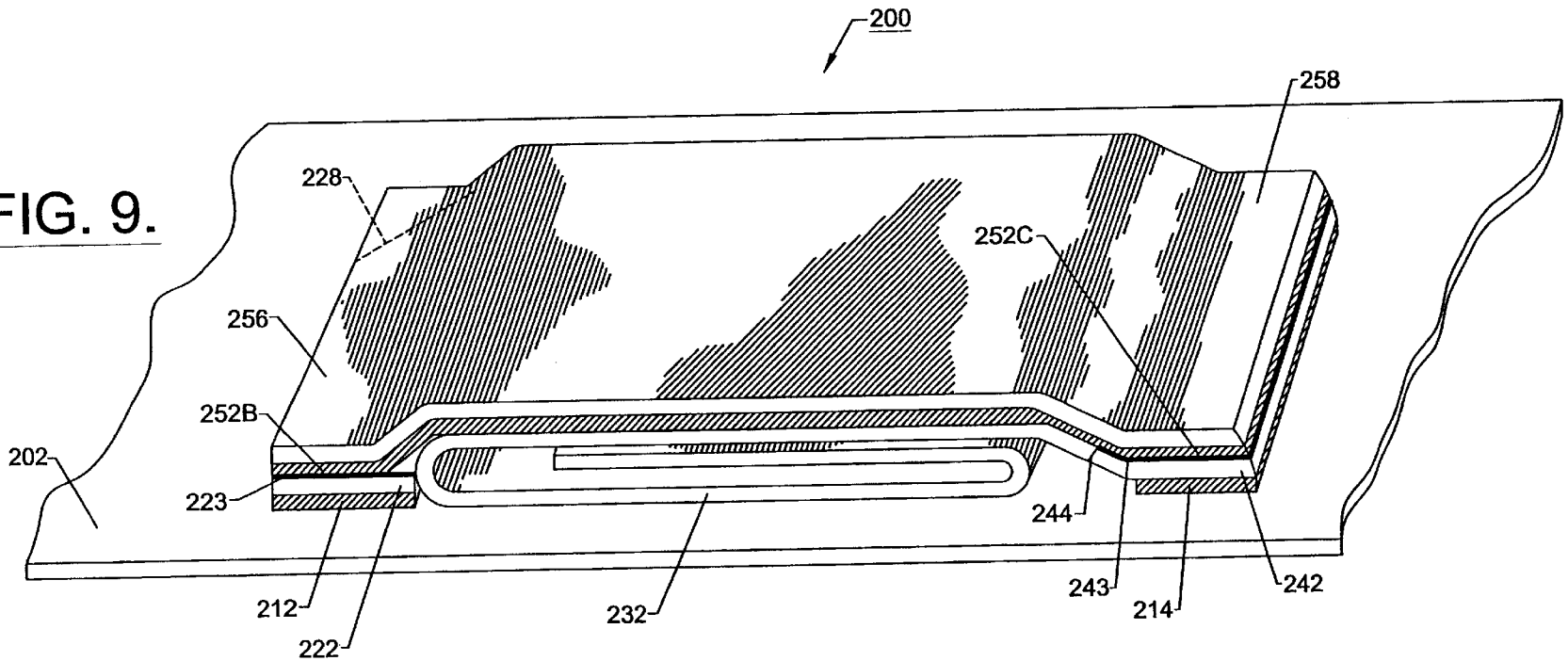
FIG. 9 is a perspective view of the label of FIG. 8 disposed on the release liner and in a closed position.

With reference to FIGS. 8 and 9, a label 200 according to further embodiments of the present invention is shown therein disposed on a release liner 202. The label 200 includes an adhesive patch 212, an adhesive patch 214, a leaflet 230, a base tab 220, a base tab 242 and a self-adhesive overlaminate 250. The leaflet 230 includes a cut line 244 in its top panel 236 defining the severed base tab 242. The leaflet 230 corresponds to the leaflet 130 except that no cut line corresponding to the cut line 148 is present and the varnish coating 243 coats the entirety of the base tab 242 separated by the cut line 244. The laminate cover 250 corresponds to the laminate cover 150. The adhesive patch 214 corresponds to the adhesive patch 114 except that adhesive is present in the region corresponding to the void 115. Additionally, no adhesive patch corresponding to the adhesive patch 110 is present, so that the bottom panel 232 of the leaflet 230 directly engages the release liner 202. Indicia may be printed on the bottom surface of the bottom panel 232.

An angular cut line 228 extends through the tab 220 to define a closure portion 222 and a pull tab 226. A varnish 223 coats the upper surface of the closure portion 222 and an adhesive patch 212 coats the lower surface of the closure portion 222. Preferably, the adhesive patch 212 does not extend beyond the cut line 228 so that the pull tab 226 is substantially free of adhesive on its undersurface. Indicia 227 such as "LIFT" or "PULL" may be printed on the upper surface of the pull tab 226.

The marginal portion 256 of the laminate cover 250 is adhered to the upper surface of the tab 220 by the laminate adhesive portion 252B. More particularly, a portion of the laminate adhesive 252B is releasably adhered to the varnish 223 of the closure portion 222 while another portion of the marginal portion 256 is permanently adhered to the upper surface of the pull tab 226. On the other end of the label 200, the marginal laminate cover portion 258 is releasably adhered to the varnish coated upper surface of the base tab 242.

In use, the label 200 may be secured to an article by means of the adhesive patches 212, 214. When the user wishes to open the label 200, the user may grasp the pull tab 226 and the overlying portion of the marginal portion 256 and pull the laminate cover 250 upwardly and rightwardly away from the tab 220. In a manner similar to that described above, the laminate adhesive 252B will peel away from the varnish 223. The user may continue pulling the laminate cover 250 away, in which case the top panel 236 and the remainder of the leaflet 230 will separate from the tab 242 along the cut line 244 and the laminate adhesive 252C underlying the marginal portion 258 will peel away from the varnish 243. Because the bottom panel 232 is not directly adhered to the article and the central portion 254 of the laminate cover 250 is adhered to the top panel 236 by the laminate adhesive 252A, the leaflet 230 (with the exception of the portion 242) will remain with the laminate cover 250 and will become separated from the article. Accordingly, only the tab 220 (less the pull tab 226) and the tab 242 will remain adhered to the article. Optionally, the tab 220 and the tab 242 may be printed with desired indicia (not shown).

Optionally, the lower surface of the bottom panel 232 may be coated with a release varnish 232A (see FIG. 10), for example, of the type described above with regard to the varnish 143. When the leaflet 230 and the laminate cover 250 are pulled away from the article and the tabs 220, 242, the laminate adhesive 252C on the underside of the marginal portion 258 will remain with the leaflet 230 and will be exposed.

Figure 10:
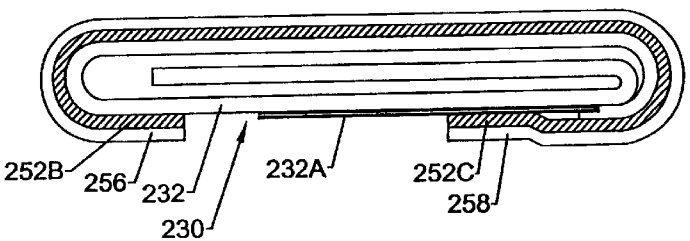
FIG. 10 is a side elevational view of the leaflet and laminate cover of the label of FIG. 8 in a re-closed position.

The user may re-close the leaflet 230 by wrapping the marginal portion 258 about the adjacent end fold of the leaflet 230 and into engagement with the varnish coated surface of the bottom panel 232 as shown in FIG. 10. When the user desires to inspect the interior pages of the leaflet 230, the user may reopen the leaflet 230 by peeling the laminate adhesive 252C and the marginal portion 258 away from the varnish coated lower surface of the bottom panel 232. In order to facilitate reopening, the tab 242 may be formed in the same manner as described with regard to the tab 142. In this way, a pull tab corresponding to the pull tab 146 may be provided between the marginal portion 258 and the bottom panel 232 for grasping by the user to begin peeling the marginal portion 258 away.

The exposed laminate adhesive 252B and the marginal portion 256 may also be wrapped about the adjacent fold of the leaflet 230 and into engagement with the bottom panel 232, as shown in FIG. 10, irrespective of whether a release varnish is provided on the underside of the bottom panel 232. The varnish coating 232A may or may not extend across the portion of the bottom panel 232 engaged by the laminate adhesive 252B.

Suitable means and methods for forming the label 200 will be apparent to those of ordinary skill in the art upon a reading of the foregoing description.

According to further embodiments of the present invention, labels may be formed which include the pull tab arrangement as described with regard to the label 100 and, on an opposing end, the pull tab arrangement as described with regard to the label 200. Labels according to these further embodiments may be opened from either end as selected by the user.

It will be appreciated from a reading of the foregoing that various modifications may be made to the labels as described herein. For example, the leaflets 130, 230 may be configured in booklet form. For example, rather than the interior panel 134 being joined to the bottom panel 132 along a fold 133, the panel 134 (as well as additional panels) may be glued or stapled along the fold 135. The interior and/or bottom panels may be omitted so the leaflet includes only a top panel and a bottom panel or only a top panel.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A resealable label comprising:

a) a leaflet comprising an upper surface, a bottom panel, and a top panel overlying said bottom panel, said top panel including an upper surface and an integral extended flap, wherein said extended flap extends beyond said bottom panel and said upper surface of said top panel is said upper surface of said leaflet;

b) a base tab disposed adjacent said leaflet, said base tab including a closure portion and a pull tab portion each having an upper surface and a lower surface, wherein said closure portion and said pull tab portion are separated from one another by a cut line therebetween;

c) a varnish coating said upper surface of said closure portion;

d) a laminate cover including:

a first laminate portion overlying said closure portion;

a second adhesive portion overlying said pull tab portion; and a third laminate portion overlying said leaflet;

e) a laminate adhesive including:

a first adhesive portion releasably and resealably securing said first laminate portion to said varnish on said upper surface of said closure portion; and a second adhesive portion securing said second laminate portion to said upper surface of said pull tab portion; and f) a closure portion adhesive coating said lower surface of said closure portion;

g) wherein said lower surface of said pull tab is substantially free of adhesive;

h) wherein said leaflet is separable from said closure portion; and i) wherein said extended flap extends to a location adjacent said closure portion.

2. The label of claim 1 including indicia disposed on said pull tab portion.

3. The label of claim 1 wherein said laminate adhesive includes a third adhesive portion securing said third laminate portion to said upper surface of said leaflet.

4. The label of claim 1 wherein said leaflet has a lower surface including a varnish coating on said lower surface.

5. The label of claim 1 including a second base tab disposed adjacent an end of said leaflet opposite said base tab and a tab adhesive coating a lower surface of said second base tab, and wherein:

said laminate cover includes a marginal laminate portion overlying said second base tab; and said laminate adhesive includes a marginal adhesive portion securing said marginal laminate portion to an upper surface of said second base tab.

6. The label of claim 5 including a second varnish coating said upper surface of said second base tab, and wherein said marginal adhesive portion releasably and resealably secures said marginal laminate portion to said second varnish on said upper surface of said second base tab.

7. The label of claim 1 wherein said leaflet includes an interior panel disposed between said top and bottom panels.

8. The label of claim 7 wherein said leaflet is a booklet.

9. The label of claim 1 wherein said base tab is separated from said leaflet.

10. The label of claim 9 wherein said base tab is separated from said leaflet by a second cut line.

11. The label of claim 1 including a leaflet base adhesive coating a lower surface of said bottom panel, wherein said leaflet base adhesive and said closure portion adhesive define an adhesive-free gap therebetween.

12. The label of claim 11 wherein said base tab is disposed substantially immediately adjacent said leaflet and is separated therefrom by a second cut line, said second cut line overlying said adhesive-free gap.

13. The label of claim 12 wherein said integrals extended flap extends to said second cut line.

14. The label of claim 1 wherein:

said top panel is joined to a bottom panel along a fold; and said base tab is disposed adjacent said fold.

15. The label of claim 14 including a second base tab disposed adjacent an end of said leaflet opposite said base tab and a tab adhesive coating a lower surface of said second base tab, and wherein:

said laminate cover includes a marginal laminate portion overlying said second base tab; and said laminate adhesive includes a marginal adhesive portion securing said marginal laminate portion to an upper surface of said second base tab.

16. The label of claim 15 including a second varnish coating said upper surface of said second base tab, and wherein said marginal adhesive portion releasably and resealably secures said marginal laminate portion to said second varnish on said upper surface of said second base tab.

17. A resealable label comprising:

a) a leaflet composing a bottom panel, a top panel overlying said bottom panel, and an interior panel disposed between said top and bottom panels, said top panel having an upper surface and said bottom panel having a lower surface, said top panel including an integral extended flap extending beyond said bottom panel;

b) a first base tab disposed adjacent said leaflet, said first base tab including a closure portion and a pull tab portion each having an upper surface and a lower surface, wherein said closure portion and said pull tab portion are separated from one another by a cut line therebetween;

c) a second base tab disposed adjacent an end of said leaflet opposite said first base tab;

d) a varnish coating said upper surface of said closure portion;

e) a laminate cover including:

a first laminate portion overlying said closure portion;

a second laminate portion overlying said pull tab portion;

a third laminate portion overlying said top panel; and a marginal laminate portion overlying said second base tab;

f) a laminate adhesives including:

a first adhesive portion releasably and resealably securing said first laminate portion to said varnish on said upper surface of said closure portion;

a second adhesive portion securing said second laminate portion to said upper surface of said pull tab portion;

a third adhesive portion securing said third laminate portion to said upper surface of said top panel; and a marginal adhesive portion securing said marginal laminate portion to an upper surface of said second base tab;

g) a tab adhesive coating a lower surface of said second tab; and h) a closure portion adhesive coating said lower surface of said closure portion;

i) wherein said lower surface of said pull tab is substantially free of adhesive;

j) wherein said leaflet is separable from said closure portion; and k) wherein said extended flap extends to a location adjacent said closure portion.

18. The label of claim 17 including a second varnish coating said upper surface of said second base tab, and wherein said marginal adhesive portion releasably and resealably secures said marginal laminate portion to said second varnish on said upper surface of said second base tab.

19. The label of claim 17 including indicia disposed on said pull tab portion.

20. The label of claim 17 wherein said leaflet is a booklet.

21. The label of claim 17 including a further varnish coating on said lower surface of said bottom panel.

22. The label of claim 17 wherein said base tab is separated from said leaflet.

23. The label of claim 22 wherein said base tab is separated from said leaflet by a second cut line.

* * * * *

UNITED STATES PATENT AND TRADEMARK OFFICE

CERTIFICATE OF CORRECTION

PATENT NO. : 6,541,090 B2
DATED : April 1, 2003
INVENTOR(S) : Grosskopf et al.

It is certified that error appears in the above-identified patent and that said Letters Patent is hereby corrected as shown below:

Title page,
Item [74], *Attorney, Agent, or Firm* should read,
-- Myers Bigel Sibley & Sajovec --

Column 9,
Line 45, should read, -- a) a leaflet comprising a bottom panel, a top panel --

Signed and Sealed this

Twenty-third Day of December, 2003

JAMES E. ROGAN
*Director of the United States Patent and Trademark Office*